US011001284B2

(12) United States Patent
Abrosimov et al.

(10) Patent No.: US 11,001,284 B2
(45) Date of Patent: May 11, 2021

(54) METHOD FOR DETERMINING LOCATION OF OTHER TRAINS FOR PTC PURPOSES

(71) Applicant: Westinghouse Air Brake Technologies Corporation, Wilmerding, PA (US)

(72) Inventors: Igor Abrosimov, N. Potomac, MD (US); Daniel McGee, Alexandria, VA (US)

(73) Assignee: WESTINGHOUSE AIR BRAKE TECHNOLOGIES CORPORATION, Wilmerding, PA (US)

( * ) Notice: Subject to any disclaimer, the term of this patent is extended or adjusted under 35 U.S.C. 154(b) by 194 days.

(21) Appl. No.: 16/206,349

(22) Filed: Nov. 30, 2018

(65) Prior Publication Data

US 2020/0172133 A1 Jun. 4, 2020

(51) Int. Cl.

| | |
|---|---|
| ***B61L 23/34*** | (2006.01) |
| ***B61L 3/00*** | (2006.01) |
| ***B61L 25/04*** | (2006.01) |
| ***B61L 25/02*** | (2006.01) |

(52) U.S. Cl.

CPC ..... *B61L 23/34* (2013.01); *B61L 3/006* (2013.01); *B61L 25/021* (2013.01); *B61L 25/04* (2013.01)

(58) Field of Classification Search

CPC ..... B61L 23/34; B61L 3/006; B61L 25/021; B61L 25/04

See application file for complete search history.

(56) References Cited

U.S. PATENT DOCUMENTS

2006/0015224 A1* 1/2006 Hilleary ..... B61L 29/00 701/19
2012/0315916 A1* 12/2012 Van Phan ..... H04W 36/08 455/442
2014/0257748 A1* 9/2014 Lundquist ..... G01B 7/14 702/150
2015/0302752 A1* 10/2015 Holihan ..... B61L 23/00 246/62
2016/0046308 A1* 2/2016 Chung ..... B61L 25/021 701/20
2017/0148323 A1* 5/2017 Shubs, Jr. ..... B61L 25/02
2018/0037241 A1* 2/2018 Sharma ..... B61L 3/008
2018/0065650 A1* 3/2018 Plotnikov ..... B61L 3/10
2018/0222505 A1* 8/2018 Chung ..... B61L 27/04
2018/0237039 A1* 8/2018 Mong ..... H04L 67/322

(Continued)

*Primary Examiner* — Peter D Nolan
*Assistant Examiner* — Wae L Louie
(74) *Attorney, Agent, or Firm* — Christopher R. Carroll; The Small Patent Law Group LLC

(57) ABSTRACT

A train-to-train warning system and method for communicating an information notification, may include receiving or sensing, by a head of train computer of a listener train, an information notification originating from an end of train device associated with a first train in a geographic area, identifying the first train based on at least one of the position of the first train or the identifier associated with the first train, determining, one or more events or conditions of the first train in the track network based on the information notification, generating an updated operation of the listener train including one or more actions, the updated operation based on the one or more events or conditions associated with the first train, and controlling a movement of the listener train based on at least one of the one or more actions.

20 Claims, 5 Drawing Sheets

(56) References Cited

U.S. PATENT DOCUMENTS

| | | | | |
|---|---|---|---|---|
| 2019/0114914 | A1* | 4/2019 | Gao | B61L 3/008 |
| 2019/0322299 | A1* | 10/2019 | Mong | B61L 15/0036 |
| 2020/0172133 | A1* | 6/2020 | Abrosimov | B61L 25/021 |
| 2020/0172134 | A1* | 6/2020 | Kernwein | G06K 9/00791 |

* cited by examiner

METHOD FOR DETERMINING LOCATION OF OTHER TRAINS FOR PTC PURPOSES

BACKGROUND

Field of the Invention

The present invention relates generally to systems and methods of train-to-train warnings via a trainlink system between a head of train (HOT) device in a locomotive and an end of train (EOT) device in a last car of a train, and, in particular, safety methods of warning a train operator using a train-to-train warning via a trainlink.

Description of Related Art

There is a growing movement to transport more material by rail as production of goods reaches capacity. Additional and improved safety systems are required to solve problems in current systems. Thus, there are efforts to improve the safety of systems used to determine the health of a train, including end of train devices. An end of train device is generally armed by a railway engineer to a head of train device to provide a safe and reliable connection between the locomotive and the end of the train.

Currently, the head of train device in the locomotive communicates with the end of train device that is coupled to the last car of the train via messages over a UHF RF link. An AAR standard process (termed the "arming process") is executed prior to the train's departure to pair the head of train device to the end of train device that is on the same train. When the head of train device is "armed" to an end of train device, it only processes the messages from the paired end of train device. Additionally, the current head of train device requires a railway engineer to directly access parameters, displays, and buttons on the end of train device. Additionally, to arm the end of train device, a person must place themselves in an unsafe position on the railway to straddle or stand on a middle of a track behind an end of train railcar to press a button or to view displays on the end of train device. In some non-limiting embodiments or aspects, an end of train device display can be difficult to view from longer distances and/or can be distorted by bright ambient light.

In certain railroad and train control and management systems (e.g., Positive Train Control system, the I-ETMS® of Wabtec Corp., etc.), enforcement of conditional authorities is required in order to prevent a train from entering an unauthorized section of track until the condition for making the authority effective has occurred. In one exemplary embodiment of an existing system, the location of the named trains (referred to as "identifying trains") in the conditional authority are confirmed by the train crew via a prompt or similar interaction from a PTC system on the display of the on-board computer on the locomotive. The terms "identifying train" or "identifying locomotive" refer to the train or locomotive listed in the movement authority dataset of a conditional authority as being in the lead of one of the trains for which the train holding that authority must wait. Assuming the crew answers the prompt correctly, the appropriate protection between trains is achieved. However, in some situations, the crew may respond incorrectly, assuming a train has passed when, in reality, it has not. This creates a situation where the authority of the train or trains named in the conditional authority may be violated, possibly resulting in a collision. The Federal Railroad Association has expressed its concern regarding this potential hazard.

Current PTC systems may not be capable and/or configured to receive a train's location (e.g., train location data, location data, etc.) other than from a remote server (e.g., dispatcher, central office, back office, etc.). When the remote server fails and/or does not otherwise send a location update, the PTC system may not be capable and/or configured to efficiently receive and/or generate accurate location data about any other trains in a geographic location (e.g., on the same track, in siding, etc.). In addition, when the remote server fails and/or does not otherwise send a location update, the PTC system may not be capable and/or configured to efficiently and/or safely receive timely indications (e.g., alerts, warnings, updates, etc.) that the trains are running too close together. In addition, when the remote server fails and/or does not otherwise send a location update, the PTC system may not be capable and/or configured to efficiently and/or safely determine any other train in the railway for safe passage without visual evaluation and a speed reduction (e.g., a speed target, warning, etc.).

SUMMARY

In some non-limiting embodiments or aspects, provided are train-to-train warning devices and systems for communicating a warning, computer-implemented train-to-train warning methods, and computer program products for a train. Preferably, provided are improved systems, methods, and computer program products that overcome certain deficiencies and drawbacks associated with existing train-to-train systems, methods, and computer program products.

In some non-limiting embodiments or aspects, provided is a computer-implemented train-to-train warning method. The method may include: receiving or sensing, by a head of train computer of a listener train, an information notification originating from an end of train device associated with a first train in a geographic area, the information notification including at least one of traversal information associated with a position of the first train in a track network or an identifier associated with the first train; identifying the first train based on at least one of the position of the first train or the identifier associated with the first train; determining, by an on-board computer having one or more processors in the listener train, one or more events or conditions of the first train in the track network based on the information notification; generating an updated operation of the listener train including one or more actions, the updated operation based on the one or more events or conditions associated with the first train; and controlling, by the on-board computer, a movement of the listener train based on at least one of the one or more actions.

In some non-limiting embodiments or aspects, provided is a system for generating an information notification on a train having an end of train device in communication with at least one head of train device. The end of train device programmed or configured to: determine traversal information associated with a position or location of a first train in a track network; generate and transmit an information notification to a second train for detecting an event and/or condition associated with the first train, the information notification including at least the traversal information and an identifier associated with the end of train device; and broadcast the information notification to a head of train computer. The head of train computer of the second train programmed or configured to: receive the information notification from the end of train device, the information notification including at least one of traversal information associated with a position of the first train in a track network and an identifier associated with the first train. An on-board computer programmed or configured to: identify the first train based on at least one of the position of the first train or the identifier associated with the first train; determine one or more events or conditions of the first train in the track network based on the information notification; generate an updated operation of the second train including one or more actions, the updated operation based on the one or more events or conditions associated with the first train; and control a movement of the second train based on at least one of the one or more actions.

In some non-limiting embodiments or aspects, provided is a computer-implemented train-to-train warning method. The method includes determining, by an end of train device having one or more processors, traversal information associated with a position of a first train in a track network, the end of train device located on an end of the first train; generating, by the end of train device, an information notification, the information notification including at least one of traversal information associated with a position of the first train in a track network or an identifier associated with the end of train device; broadcasting, by the end of train device, the information notification to one or more of the head of train computers located on at least one second train; determining, by a head of train computer of the at least one second train, an information notification is from an end of train broadcast associated with the first train; determining, by an on-board computer having one or more processors, an indication as to a proximity of the first train to the at least one second train in the track network based on at least one of the traversal information or the identifier; determining, by the on-board computer, one or more actions associated with avoiding the first train in the track network based on the indication as to the location of the first train; and controlling, by the on-board computer, a movement of the at least one second train based on at least one of the one or more actions to avoid the first train.

In some non-limiting embodiment or aspect, provided is a computer program product comprising at least one non-transitory computer-readable medium including program instructions that, when executed by at least one computer including at least one processor, causes the at least one computer to: determine traversal information associated with a position of a first train in a track network; generate an information notification including the traversal information and an identifier associated with an end of train device; broadcast the information notification to one or more of the head of train computers located on at least one second train; determine an information notification broadcast received at a second train is associated with the first train; determine an indication as to a proximity of the first train to the at least one second train in the track network based on the traversal information; determine one or more actions based on at least one of a condition or event associated with the indication as to the proximity of the first train to the at least one second train; and control a movement of the second train based on at least one of the one or more actions to avoid the first train.

In some non-limiting embodiments or aspects, provided is an end of train device including one or more processors; a pressure sensor for determining an air pressure in an air brake pipe; a communication system connected to the processor; and a positioning system connected to the processor, wherein the end of train device is programmed or configured to determine traversal information associated with a position or location of a first train in a track network; generate an information notification including the traversal information and an identifier associated with the end of train device; and broadcast the information notification to one or more of the head of train computers located on at least one second train.

In some non-limiting embodiments or aspects, provided is a computer-implemented train-to-train communication method. The method includes determining, by an end of train device having one or more processors associated with a first train, traversal information associated with a position of the first train in a track network; generating, by the end of train device, an information notification, the information notification including the traversal information and an identifier associated with the first train; broadcasting, by the end of train device, the information notification to one or more of the head of train computers located on at least one second train; and controlling, by an on-board computer, at least one of a movement of the first train or the at least one second train based on the information notification.

In some non-limiting embodiment or aspect, provided is a computer program product comprising at least one non-transitory computer-readable medium including program instructions that, when executed by at least one computer including at least one processor, causes the at least one computer to: receive or sense an information notification originating from an end of train device associated with a first train in a geographic area, the information notification including at least one of traversal information associated with a position of the first train in a track network or an identifier associated with the first train; identify the first train based on at least one of the position of the first train or the identifier associated with the first train; determine one or more events or conditions of the first train in the track network based on the information notification; generate an updated operation including one or more actions, the updated operation based on the one or more events or conditions associated with the first train; and control a movement of a second train based on at least one of the one or more actions.

The present invention is neither limited to nor defined by the above summary. Rather, reference should be made to the claims for which protection is sought with consideration of equivalents thereto.

Some non-limiting embodiments or aspects will now be described in the following numbered clauses:

Clause 1: A computer-implemented train-to-train warning method, comprising: receiving or sensing, by a head of train computer of a listener train, an information notification originating from an end of train device associated with a first train in a geographic area, the information notification including at least one of traversal information associated with a position of the first train in a track network or an identifier associated with the first train; identifying the first train based on at least one of the position of the first train or the identifier associated with the first train; determining, by an on-board computer having one or more processors in the listener train, one or more events or conditions of the first train in the track network based on the information notification; generating an updated operation of the listener train including one or more actions, the updated operation based on the one or more events or conditions associated with the first train; and controlling, by the on-board computer, a movement of the listener train based on at least one of the one or more actions.

Clause 2: The method according to clause 1, wherein the information notification comprises an intra-train operational notification broadcast including operational information for communicating information relevant to an end of the first train to an on-board computer in a head of the listener train.

Clause 3: The method according to clauses 1 and 2, further comprising: determining the information notification comprises the intra-train operational notification broadcast from the first train and including operational information associated with the one or more events or conditions of the first train; and determining an action based on the one or more events or conditions of the first train and an event or condition in the listener train.

Clause 4: The method according to clauses 1-3, wherein the one or more events or conditions are based on at least one parameter, the at least one parameter associated with at least one of track geometry, weather conditions, track conditions, location or position coordinates, velocity or acceleration of the listener train, or velocity or acceleration of one or more other trains.

Clause 5: The method according to clauses 1-4, wherein the information notification comprises an inter-train warning message, including a warning portion for communicating warning information relevant to one or more trains within a threshold of the first train.

Clause 6: The method according to clauses 1-5, wherein the inter-train warning message is directed to the listener train, the warning information including particular information relevant to the listener train.

Clause 7: The method according to clauses 1-6, wherein the information notification is transmitted at a predetermined time, randomly or periodically.

Clause 8: The method according to clauses 1-7, wherein the inter-train warning message is directed to the listener train, the warning information including a particular event or condition relevant to the listener train, the method further comprising: determining an action based on the particular event or condition relevant to the listener train.

Clause 9: The method according to clauses 1-8, wherein the inter-train warning message is not directed to the listener train, the warning information including a general event or condition relevant to the listener train and one or more other trains, the method further comprising: determining an action based on the general event or condition, wherein the action is based on comparing at least one of the general event or condition to information received and sensed by the listener train to determine a warning alert.

Clause 10: The method according to clauses 1-9, wherein determining the action further comprises: determining the first train is traveling on a route including at least one first track in a railway of a current route of the listener train; comparing train information of the listener train with at least one of a distance to the first train, a speed of the first train, or a condition of the at least one first track in the railway; determining a safe action for travel based on comparing train information; and controlling the train based on the safe action.

Clause 11: The method according to clauses 1-10, further comprising: alerting an operator as to at least one action associated with avoiding a hazard in the track network; and controlling a movement of the listener train based at least partially on the at least one action.

Clause 12: The method according to clauses 1-11, further comprising: displaying, by a display connected to the on-board computer, in response to an alert, a map including a position or location of the first train; communicating a plurality of actions including the at least one action associated with avoiding the hazard to an operator interface onboard a control car of the listener train; receiving, with the operator interface, a selection of at least one of the plurality of actions; and issuing a command in response to the selection.

Clause 13: A train-to-train warning system for generating an information notification on a train, comprising: (a) an end of train device in communication with at least one head of train device, the end of train device programmed or configured to: (i) determine traversal information associated with a position or location of a first train in a track network; (ii) generate and transmit an information notification to a second train for detecting an event and/or condition associated with the first train, the information notification including at least the traversal information and an identifier associated with the end of train device; and (iii) broadcast the information notification to a head of train computer; (b) the head of train computer of the second train programmed or configured to: (i) receive the information notification from the end of train device, the information notification including at least one of traversal information associated with the position of the first train in the track network and the identifier associated with the first train; and (c) an on-board computer programmed or configured to: (i) identify the first train based on at least one of the position of the first train or the identifier associated with the first train; (ii) determine one or more events or conditions of the first train in the track network based on the information notification; (iii) generate an updated operation of the second train including one or more actions, the updated operation based on the one or more events or conditions associated with the first train; and (iv) control a movement of the second train based on at least one of the one or more actions.

Clause 14: The system for generating an information notification on a train according to clause 13, wherein the information notification comprises an inter-train warning message comprising a warning portion for communicating warning information relevant to one or more trains within a threshold of the first train, wherein the inter-train warning message is directed to the second train, the warning information including a particular event or condition relevant to the second train, the on-board computer further configured to: determine an action based on the particular event or condition relevant to the second train.

Clause 15: The system for generating an information notification on a train according to clauses 13 and 14, wherein the information notification comprises an inter-train warning message comprising a warning portion for communicating warning information relevant to one or more trains within a threshold of the first train, wherein the inter-train warning message is not directed to the second train, the warning information including a general event or condition relevant to the second train and one or more other trains, the on-board computer further configured to: determine an action based on the general event or condition, wherein the action is based on comparing at least one of the general event or condition to information received and sensed by the second train to determine a warning alert.

Clause 16: The system for generating an information notification on a train according to clauses 13-15, wherein determining the one or more actions, the on-board computer further configured to: determine the first train is traveling on a route including at least one first track in a railway of a current route of the second train; compare train information of the second train with at least one of a distance to the first train, a speed of the first train, or a condition of the at least one first track in the railway; determine a safe action for travel based on comparing train information; and control the train based on the safe action.

Clause 17: The system for generating an information notification on a train according to clauses 13-16, further configured to: alert an operator as to at least one action associated with avoiding a hazard in the track network; and control a movement of the second train based at least partially on the at least one action.

Clause 18: The system for generating an information notification on a train according to clauses 13-17, further configured to: display, by a display connected to the on-board computer, in response to receiving an alert, a map including a position or location of the first train; communicate a plurality of actions including the at least one action associated with avoiding the hazard to an operator interface onboard a control car of the second train; receive, with the operator interface, a selection of at least one of the plurality of actions; and issue a command in response to the selection.

Clause 19: A computer program product comprising at least one non-transitory computer-readable medium including program instructions that, when executed by at least one computer including at least one processor, causes the at least one computer to: receive or sense an information notification originating from an end of train device associated with a first train in a geographic area, the information notification including at least one of traversal information associated with a position of the first train in a track network or an identifier associated with the first train; identify the first train based on at least one of the position of the first train or the identifier associated with the first train; determine one or more events or conditions of the first train in the track network based on the information notification; generate an updated operation including one or more actions, the updated operation based on the one or more events or conditions associated with the first train; and control a movement of a second train based on at least one of the one or more actions.

Clause 20: The computer program product of clause 19, wherein the information notification comprises an intra-train operational notification broadcast including operational information for communicating information relevant to an end of the first train to an on-board computer in a head of the second train, the computer program product including further program instructions that, when executed by at least one computer including at least one processor, causes the at least one computer to: determine the information notification comprises an intra-train operational notification broadcast from the first train and including operational information associated with an event or condition of the first train; and determine an action based on the event or condition of the first train and an event or condition in the second train.

DETAILED DESCRIPTION

Figure 1:
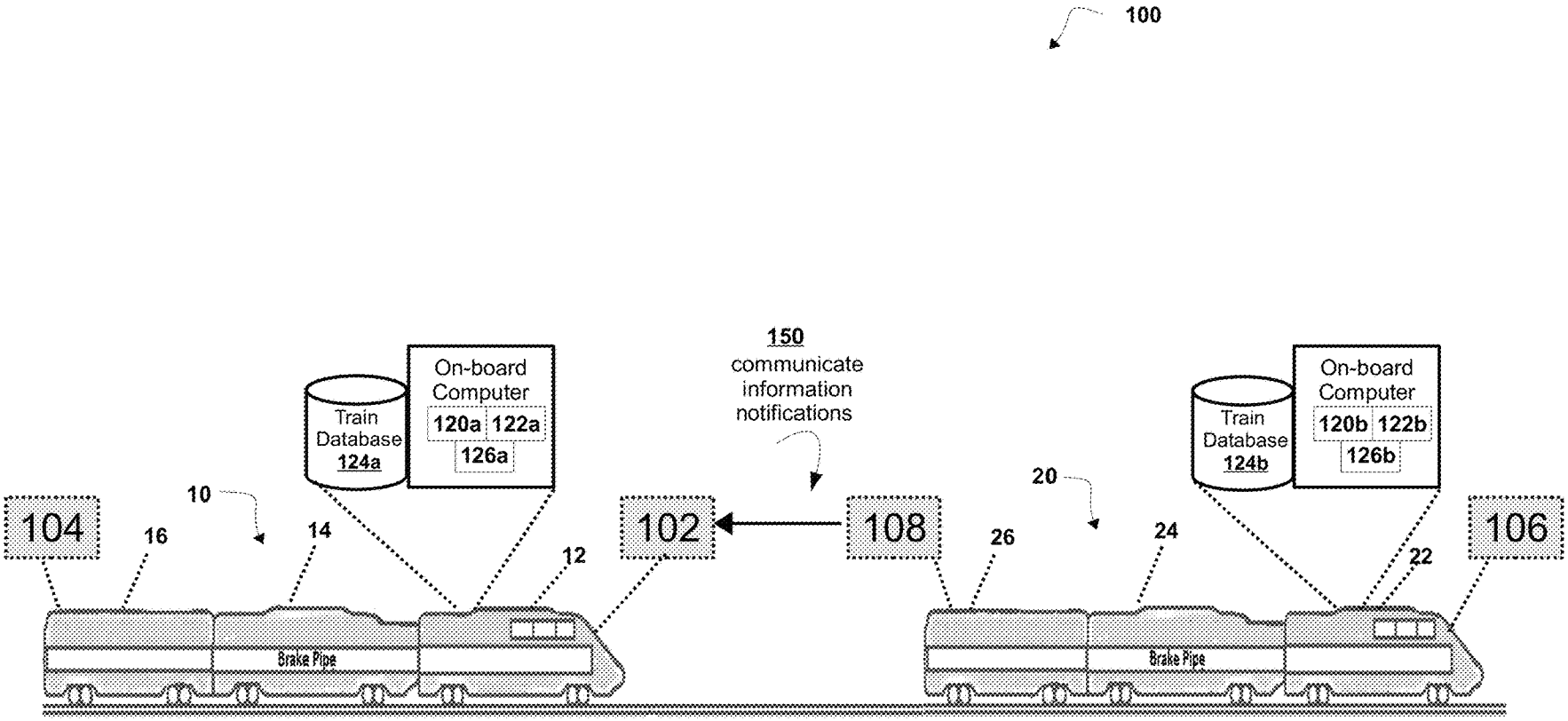
FIG. 1 illustrates a train-to-train warning system according to a preferred and non-limiting embodiment or aspect.

As disclosed herein, in some non-limiting embodiments, a computer-implemented train-to-train warning method may include: receiving, by a head of train computer of a listener train, an information notification originating from an end of train device associated with a first train in a geographic area, the information notification including at least one of traversal information associated with a position of the first train in a track network or an identifier associated with the first train, identifying the first train based on at least one of the position of the first train or the identifier associated with the first train, determining, by an on-board computer having one or more processors in the listener train, one or more event or conditions of the first train in the track network based on the information notification; generating an updated operation of the listener train including one or more actions, the updated operation based on the one or more event or conditions associated with the first train; and controlling, by the on-board computer, a movement of the listener train based on at least one of the one or more actions.

In this way, a train-to-train warning method includes receiving traversal information associated with a position of any train in the railway (e.g., receive from an EOT device a train's location, etc.) other than from a remote server (e.g., dispatcher, central office, back office, etc.) via a communication link between a HOT device and an EOT device. Accordingly, a train-to-train warning method reduces or eliminates a processing delay associated with a PTC system not receiving (e.g., efficiently receiving and/or reporting accurate location data about any other trains on the same track and/or siding associated with the track). Additionally, and/or alternatively, the train-to-train warning method includes receiving timely indications (e.g., alerts, warnings, updates, etc.) to efficiently and/or safely report any other trains in the railway running too close (e.g., within a threshold of a listener train, etc.). In addition, the train-to-train warning system may be capable and/or configured to efficiently and/or safely determine any other train in the railway for safe passage without visual evaluation and a speed reduction. For example, the train-to-train warning system is capable and/or configured to efficiently and/or safely determine any other train in the railway when the remote server fails and/or does not otherwise send a location update.

It is to be understood that the invention may assume various alternative variations and step sequences, except where expressly specified to the contrary. It is also to be understood that the specific products, systems, and processes illustrated in the attached drawings, and described in the following specification, are simply exemplary embodiments of the invention. Hence, specific dimensions and other physical characteristics related to the embodiments disclosed herein are not to be considered as limiting. As used herein, the singular form of "a", "an", and "the" include plural referents unless the context clearly dictates otherwise.

As used herein, the terms "communication" and "communicate" refer to the receipt, transmission, or transfer of one or more signals, messages, commands, or other types of data. For one unit or device to be in communication with another unit or device means that the one unit or device is able to receive data from and/or transmit data to the other unit or device. A communication may use a direct or indirect connection and may be wired and/or wireless in nature. Additionally, two units or devices may be in communication with each other even though the data transmitted may be modified, processed, routed, etc., between the first and second unit or device. For example, a first unit may be in communication with a second unit even though the first unit passively receives data and does not actively transmit data to the second unit. As another example, a first unit may be in communication with a second unit if an intermediary unit processes data from one unit and transmits processed data to the second unit. It will be appreciated that numerous other arrangements are possible. Any known electronic communication protocols and/or algorithms may be used such as, for example, TCP/IP (including HTTP and other protocols), WLAN (including 802.11 and other radio frequency-based protocols and methods), analog transmissions, Global System for Mobile Communications (GSM), private wireless, public wireless, 160/220/900 MHz VHF, WiFi, UHF 452-458 MHz, WiMAX, Cellular 3G/4G/5G, omni-directional, and/or the like Referring now to FIG. 1, FIG. 1 is a diagram of a non-limiting embodiment of a train-to-train warning system 100 in which systems and/or methods, described herein, can be implemented. As shown in FIG. 1, train 10 includes a locomotive 12, one or more railcars 14, and an end of train railcar 16. Systems and/or devices of train-to-train warning system 100 can interconnect via wired connections, wireless connections, or a combination of wired and wireless connections.

With continued reference to FIG. 1, a preferred and non-limiting embodiment or aspect of a train-to-train warning system 100 may include a HOT device 102 (e.g., a locomotive control unit (LCU), head of train unit, etc.) located in or associated with the locomotive 12 of the train 10. In some non-limiting embodiments, the HOT device 102 is mounted to the train operator's console in the locomotive 12. In some non-limiting embodiments or aspects, the HOT device 102 may be connected to an EOT device (e.g., radio telemetry systems, end of train unit, etc.) on a railcar 16, typically the last railcar, in the train 10. For example, the EOT device 104 is mounted to the end of train railcar 16, the EOT device 104 is coupled to the brake pipe by means of a hose and a glad hand.

In some non-limiting embodiments, the EOT device 104 transmits to the HOT device 102 via radio signal data pertaining to the pressure in the brake pipe and the motion of the last railcar. To accomplish this, the EOT device 104 includes a position sensor to sense location and/or heading of the railcar, a motion sensor to sense movement of the railcar, a pressure transducer to monitor brake pipe pressure, a microprocessor unit to control the overall operation of these components, and a transmitter that the microprocessor unit uses to transmit this last railcar data. In the locomotive 12, the HOT device 102 includes a receiver to receive transmissions from the EOT device 104, a primary display, and a microprocessor unit to direct the operation of these components.

In some non-limiting embodiments or aspects, EOT device 104 includes a positioning (e.g., navigation, mapping, etc.) system (e.g., a global positioning (GPS) receiver and antenna, at least one wheel tachometer/speed sensor, magnetic compass for orientation, and/or the like). In some non-limiting embodiments, the positioning system may be programmed or configured to sense or determine a location or position of a portion of the train.

In some non-limiting embodiments or aspects, the EOT device 104 may be programmed to determine or receive a location or position of at least a portion of the train based at least partially on the location or position sensed or determined by the at least one positioning system.

In some non-limiting embodiments or aspects, the EOT device 104 may be programmed or configured to generate or receive an information notification based at least partially on the location or position sensed or determined by the at least one positioning system.

In some non-limiting embodiments or aspects, the HOT device 102 may be programmed or configured to generate or receive an information notification based at least partially on the location or position sensed or determined by the at least one positioning system.

In some non-limiting embodiments or aspects, the HOT device 102 continuously updates the train operator with the status of operations at the rear of the train. More notably, if a potentially dangerous situation arises such as the brake pipe pressure plunges suddenly or drops below a predetermined level, the HOT device 102 operates to warn the train operator that an emergency condition exists at the rear of the train. In some non-limiting embodiments or aspects, the emergency brake application starts at the locomotive and progresses along the brake pipe to the last railcar. In some non-limiting embodiments, the emergency brake application starts at the locomotive and the last railcar.

In some non-limiting embodiments or aspects, the EOT device 104 and the HOT device 102 are each equipped with a transceiver (e.g., combination transmitter and receiver, separate transceiver and receiver, etc.). In some non-limiting embodiments, the EOT device 104 also has an emergency brake valve that is controlled by its microprocessor unit, and the HOT device 102 also includes an emergency toggle switch. In some non-limiting embodiments, by toggling this switch in an emergency, the train operator can cause the HOT device 102 to transmit an emergency brake radio signal to the EOT device 104. In some non-limiting embodiments, the EOT device 104 includes a microprocessor unit, for example, to respond to an emergency signal by commanding its emergency brake valve to reduce the pressure in the brake pipe at an emergency rate.

In some non-limiting embodiments or aspects, the HOT device 102 has a primary display panel which features a dedicated display for each of several types of last railcar data. The last railcar data displayed includes brake pipe pressure, low battery condition, whether the railcar is stopped or in motion, and whether an emergency has been enabled or disabled. The HOT device 102 also has a supplemental message display by which it visually conveys additional information such as, for example, data related to arming of the EOT system and whether or not the EOT device 104 and HOT device 102 are communicating properly.

In some non-limiting embodiments or aspects, a Service Interface Unit (SIU) connects between the serial port of the HOT device 102 and the brake pipe on the locomotive 12. The SIU provides the HOT device 102 with the current brake pipe pressure. In some non-limiting embodiments, the HOT device 102 automatically initiates a service brake application at the last railcar simultaneously with the service reduction in brake pipe pressure initiated from the locomotive 12. For example, the HOT device 102 in the locomotive 12 automatically transmits a service brake radio signal to the EOT device 104 when it detects a service reduction in brake pipe pressure via the SIU.

In some non-limiting embodiments or aspects, EOT device 104 (e.g., microprocessor unit, CPU, etc.) responds to a service brake signal by commanding its emergency valve to reduce the brake pipe pressure from the last railcar at the same service rate as that ordered by the locomotive brake equipment at the head of the train. In some non-limiting embodiments or aspects, the HOT device 102 also automatically transmits an emergency brake signal when an emergency reduction in brake pipe pressure has been initiated by brake equipment of the locomotive 12. In some non-limiting embodiments or aspects, the HOT device 102 includes an emergency toggle switch to transmit this emergency brake signal.

In some non-limiting embodiments or aspects, after railcars are coupled to the locomotive(s) to form a train and before that train is put into service, a train operator must arm (e.g., authorize, etc.) a HOT device 102 in the lead locomotive 12 to communicate with the EOT device 104 on the particular train 10. The arming protocol prevents a HOT device 102 on one train from being erroneously or maliciously used to apply the brakes on another train. To this end, the HOT device 102 includes a thumb wheel switch assembly and a nonvolatile memory in which an identification code unique to a particular EOT device 104 can be stored. With that EOT device 104 on the last railcar, only when the train operator sets the thumb wheel switches to correspond to the EOT identification code stored in its memory is the HOT device 102 authorized to communicate with the EOT device 104 on the train. The HOT device 102 retains in its memory the identification code for that particular EOT device 104 until armed for a different EOT device 104.

With continued reference to FIG. 1, a preferred and non-limiting embodiment or aspect of a train-to-train warning system 100 may include one or more additional trains as shown in FIG. 1. By way of example, train 20 includes a locomotive 22, one or more railcars 24, and an end of train railcar 26. As shown by reference number 150 in FIG. 1, information notifications are communicated between train 10 and train 20. For example, systems and/or devices of train-to-train warning system 100 can communicate (e.g., connect, interconnect, transmit, receive, etc.) between trains via wired connections, wireless connections, or a combination of wired and wireless connections.

In some non-limiting embodiments or aspects, train 20 includes systems and devices similar to train 10, including a HOT device 106 (e.g., a locomotive control unit (LCU), head of train unit, etc.) located in or associated with the locomotive 22 of the train 20. In some non-limiting embodiments or aspects, the HOT device 106 is mounted to the train operator's console in the locomotive. In some non-limiting embodiments or aspects, the HOT device 106 may be connected to an EOT device 108 (e.g., radio telemetry systems, end of train unit, etc.) on an end of train railcar 26. For example, the EOT device 108 is mounted to the end of train railcar 26.

In some non-limiting embodiments or aspects, the HOT device 102 is armed to communicate with a different EOT device 104 (e.g., armed to a new HOT device, etc.) when a railroad employee pushes a test button on the new EOT device 104 to transmit a first arming signal. For example, the arming signal includes the identification code of the EOT device 104 along with a special message identifier and confirmation bit. In some non-limiting embodiments or aspects, when the HOT device 102 receives the transmission, it displays an ARM NOW message if the stored code differs from the identification code of the new EOT device 104. In some non-limiting embodiments or aspects, the HOT device 102 includes a COMM TEST/ARM button to initiate a status update request (SUR) (e.g., by manually pushing the on button within six seconds of the ARM NOW message being displayed, etc.). If the EOT device 104 receives the SUR within six seconds from the time the EOT test button was pushed, the EOT device 104 responds by transmitting a second authorization signal. This signal contains a special message identifier and confirmation bit. Upon receiving the EOT device's 104 response, and if its thumb wheel switches have been set to the identification code of the new EOT device 104, the HOT device 102 then displays the ARMED message and stores in its nonvolatile memory the identification code of the new EOT device 104 thereby overwriting the previously stored code.

In some non-limiting embodiments or aspects, the HOT device in the locomotive communicates with a EOT device that is coupled to the last car of the train via messages over a UHF RF link. An AAR standard process (termed the "arming process") is executed prior to the train's departure to pair the HOT device to the EOT device that is on the same train. When the HOT device is "armed" to an EOT device, it only processes the RF messages from that EOT device, although it can still receive messages from other EOT devices. An RF signal of the EOT device is an omnidirectional broadcast, so the signal can be received by the HOT devices in trains that are trailing behind the EOT device in the railway.

In some non-limiting embodiments or aspects, the HOT device 102 communicates with a different EOT device 108 without arming HOT device 102 to EOT device 108. For example, the HOT device 102 may be programmed or configured to directly or indirectly receive an information notification (e.g., location update, location message, identity update, etc.) from EOT device 108 located in or associated with the end of train railcar 26. For example, the HOT device 102 may be programmed or configured to sense (e.g., listen, determine) information notifications from EOT device 108 located in or associated with train 20. For example, EOT device 108 may transmit an information notification (e.g., transmit an omnidirectional broadcast via an RF signal, etc.) programmed so that the signal can be received by HOT device 102 in train 10 that is trailing behind the EOT.

In some non-limiting embodiments or aspects, the systems and methods described herein may be implemented on or in connection with a train (e.g., train 10, train 20, etc.) with at least one locomotive 12 having an on-board computer (e.g., on-board computer 120*a*, 120*b*). For example, the on-board computer 120*a* of train 10 may be located at any position or orientation on the train. In some non-limiting embodiments or aspects, the on-board computer 120*a* (e.g., on-board controller, on-board computer system, train management computer, and/or the like) performs the calculations for the Positive Train Control (PTC) system and includes a communication device 122*a* and a train database 124*a* populated with data and/or which receives specified data and information from other trains, remote servers, back office servers, central dispatch, and/or the like, where this data may include track profile data, train data, information about switch locations, track heading changes (e.g., curves, and distance measurements), train consist information (e.g., the number of locomotives, the number of cars, the total length of the train, and/or the like), and/or the like. In some non-limiting embodiments or aspects, the on-board computer 120*a* includes PTC functions (e.g., train management, computer displays, cab signal monitors, brake and systems interfaces, an event recorder, etc.). In some non-limiting embodiments or aspects, a HOT device is connected to the on-board computer by a wireless or wired connection.

In some non-limiting embodiments or aspects, the HOT device 102 may be programmed or configured to directly or indirectly communicate an information notification to an on-board computer 120*a* located in or associated with a locomotive 12 of the train 10.

In some non-limiting embodiments or aspects, the on-board computer 120*a* also includes or is in communication with the appropriate braking system and other software or programs to effectively implement the systems and methods according to the present invention. In some non-limiting embodiments or aspects, the on-board computer 120*a* receives real-time inputs from various locomotive control settings or components, including a positioning (e.g., navigation system, mapping system, etc.) system (e.g., a GPS receiver, at least one wheel tachometer/speed sensor, and/or the like). Further, the on-board computer 120*a* includes or is in communication with a communication device 122*a* (e.g., a data radio, a communication interface, a communication component, and/or the like), which facilitates communication by or between locomotives 12 and/or the locomotive 12 and some remote server or computer system (e.g., a central controller, a back office server, a remote server, central dispatch, back office PTC components, various wayside devices, such as signal or switch monitors, other on-board computers in the railway system, etc.). Further, this communication may occur wirelessly or in a "hard wired" form, e.g., over the rails of the track. In addition, the on-board computer 120*a* includes or is communicating via a visual display device 126*a*, such as the operator's display in the cab of the locomotive 12, or visual display device 126*b* of locomotive 22. This visual display device 126*a* is used to present information and data to the operator of the train. In some non-limiting embodiments or aspects, the train database 124*a* includes information about switch locations, track heading changes (e.g., curves), and distance measurements, while the on-board computer 120*a* receives, from a remote computer (e.g., the back office server, etc.), train consist information (e.g., number of locomotives, cars, and total length of the train, etc.). Accordingly, the presently-invented system and methods can be effectively implemented and used by or on such a locomotive 12 having such an on-board computer 120*a* and associated components. Of course, it is envisioned that any type of train management system can be used within the context and scope of the present invention.

In some non-limiting embodiments or aspects, the on-board computer 120*a* receives updates from some remote server or computer system (e.g., a central controller, a back office server, a remote server, central dispatch, dispatching system, communications server, back office PTC components, various wayside devices, such as signal or switch monitors, other on-board computers 120*a* in the railway system, etc.). For example, the on-board computer 120*a* receives updates from a back office server (e.g., remote server) about train 20 on the same track, with a timely indication that the trains are running too close together.

In some non-limiting embodiments or aspects, for example, the on-board computer 120*a* may not receive and/or obtain an update from a back office (e.g., remote server) about train 20 on the same track that the trains are running too close together or may not obtain in a timely indication that the train 10 and train 20 are running too close together. In some non-limiting embodiments or aspects, the HOT device 102 may be programmed or configured to directly or indirectly communicate an information notification to the on-board computer 120*a* located in or associated with a locomotive 12 of the train 10, a timely indication that the train 10 and train 20 are running too close together. For example, the HOT device 102 may be programmed or configured to directly or indirectly communicate an information notification to the on-board computer 120*a* based on an information notification from EOT device 108 of train 20.

In some non-limiting embodiments or aspects, the HOT device 102 may be programmed or configured to directly or indirectly communicate an information notification to the on-board computer 120*a* located in or associated with a locomotive of the train 10, a timely indication that a train is waiting in siding and an end of train railcar's 16 position is not fully determined. For example, the HOT device 102 may be programmed or configured to directly or indirectly communicate an information notification to the on-board computer 120*a* located in or associated with locomotive 12 of the train 10 to provide a train-to-train warning that end of the train railcar 16 is located in the railway and provide an action (e.g., speed reduction for safe passage without visual evaluation and thus require speed reduction, speed restriction for visual evaluation, etc.).

In some non-limiting embodiments or aspects, the HOT device 102 may be programmed or configured to directly or indirectly communicate a train-to-train warning to an on-board computer 120*a* located in or associated with a locomotive of the train.

In some non-limiting embodiments or aspects, the train-to-train warning system 100 determines a safe distance to maintain between a first train and a second train on the same track (e.g., from the back of the train, the front of the train, etc.). For example, train-to-train warning system 100 determines a safe distance for a train stopped around a curve and no longer in a visible condition.

In some non-limiting embodiments or aspects, the EOT device on a first train broadcasts its identification number and location information (e.g., latitude, longitude, speed, heading, location uncertainty, etc.).

In some non-limiting embodiments or aspects, the HOT device on the second train receives the broadcast from the EOT device, including a message from the first train and extracts the data from the message, the HOT device on the second train sends its own identification and location information and EOT device identification and location information to the on-board PTC associated with the first train, the on-board PTC reads the data and, using the train database (e.g., track location database), determines that both trains are on the same track.

In some non-limiting embodiments or aspects, the on-board PTC computer calculates both the actual distance between the two trains as well as the safe distance between the two trains, the on-board PTC commands the second train to apply brakes to slow down or stop in order to avoid a potential collision with the first train.

In some non-limiting embodiments or aspects, the train-to-train warning system 100 determines a safe entry into a railway yard. For example, another train may be on the same track that is not being properly handled by the dispatcher.

In some non-limiting embodiments or aspects, the EOT device on a train in the railway yard broadcasts its identification number and location information (e.g., latitude, longitude, speed, heading, location uncertainty, etc.), the HOT device on the train heading into the railway yard receives the broadcast from the EOT device, including a message from the train already in the railway yard and extracts the data from the message. In some non-limiting embodiments or aspects, the HOT device on the train heading into the railway yard sends its own identification and location information and the other train's EOT device identification and location information to the on-board PTC. In some non-limiting embodiments or aspects, the on-board PTC reads this data and, using the track location database, determines both trains are on the same track and calculates both the actual distance between the two trains as well as the safe distance between the two trains. In some non-limiting embodiments or aspects, the on-board PTC communicates this information to the on-board PTC back office.

In some non-limiting embodiments or aspects, the on-board PTC commands the train outside the railway yard to apply the brakes to slow down or stop to avoid a potential collision with the train in the railway yard.

In some non-limiting embodiments or aspects, the on-board PTC back office informs the dispatcher of the incoming train and any possible danger.

In some non-limiting embodiments or aspects, train-to-train warning system 100 determines an end of train (e.g., tail, rear, etc.) is in the railway (e.g., occupying a first railway and a portion of a second railway, sticking out, etc.), but not visible. For example, a train waiting in siding to let another train pass.

In some non-limiting embodiments or aspects, the train-to-train warning system 100 determines an EOT device on a train in the siding broadcasting an identification number and location information (e.g., latitude, longitude, speed, heading, location uncertainty, etc.). In some non-limiting embodiments or aspects, the HOT device on the train heading down the tracks receives the broadcast from the EOT device, including a message from the train in the siding and extracts the data from the message.

In some non-limiting embodiments or aspects, the HOT device sends its own identification and location information and the other train's EOT device identification and location information to on-board PTC, the on-board PTC reads the data, using the track location database, to determine a part of the train in the siding may be on tracks.

In some non-limiting embodiments or aspects, the on-board PTC communicates this information to the back office PTC, such as, for example, commands brake application to slow down or stop (if needed) in order to avoid a potential collision.

In some non-limiting embodiments or aspects, the on-board PTC back office requests the operator of the train in the siding to move further forward in the siding.

In some non-limiting embodiments or aspects, the HOT device is configured to pass messages to an on-board PTC having the entire database of any EOT device.

In some non-limiting embodiments or aspects, the on-board PTC cross references the database to find out how to proceed by processing train-to-train warning notifications when a train is running too close, or running too fast.

In some non-limiting embodiments or aspects, the EOT device on the first train broadcasts its identification number and location information (e.g., latitude, longitude, speed, heading, location uncertainty, etc.).

In some non-limiting embodiments or aspects, the HOT device on the second train receives the broadcast from the EOT device, including a message from the first train, and extracts the data from the message.

In some non-limiting embodiments or aspects, the HOT device on the second train sends its own identification and location information and the first train's EOT device identification and location information to the on-board PTC.

In some non-limiting embodiments or aspects, the on-board PTC reads this data and, using the train database 124*a*, calculates both the actual distance between the two trains as well as the safe distance between the two trains, and the on-board PTC commands the second train to apply brakes to slow down or stop (if needed) to avoid a potential collision with the first train.

Figure 2:
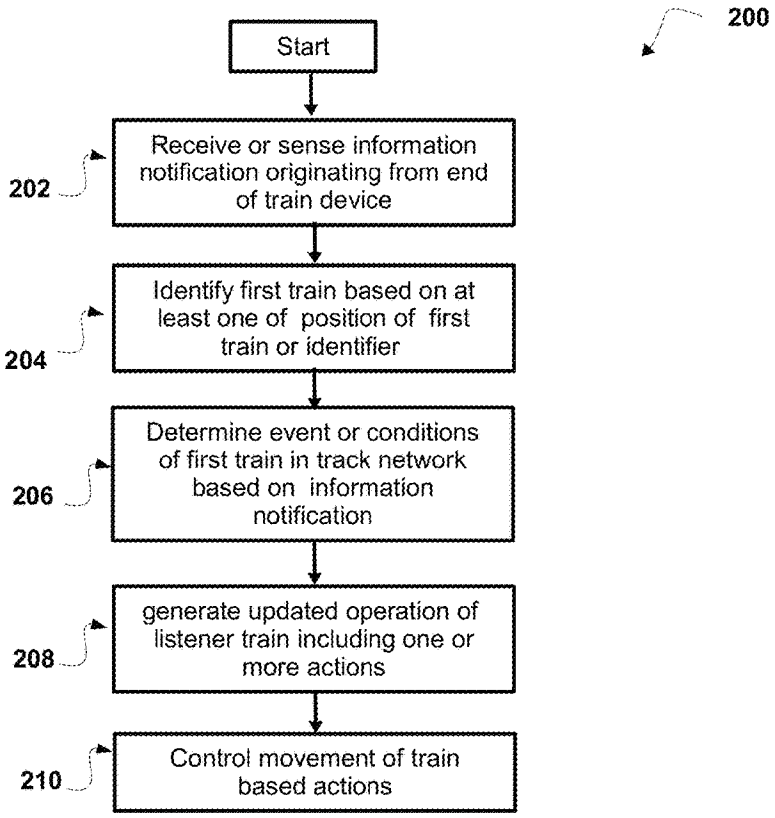
FIG. 2 illustrates a flowchart of a non-limiting embodiment of a process for a train-to-train warning system of a preferred and non-limiting embodiment or aspect.

Referring now to FIG. 2, FIG. 2 is a flowchart of a non-limiting embodiment of a process 200 for train-to train warnings in a trainlink system between a HOT device in a locomotive and an EOT device in a last car of a train. In some non-limiting embodiments or aspects, one or more of the steps of process 200 are performed (e.g., completely, partially, etc.) by HOT device 102, EOT device 104, and/or EOT device 108. In some non-limiting embodiments, one or more of the steps of process 200 are performed (e.g., completely, partially, etc.) by another device or a group of devices separate from or including on-board computer 120*a* (e.g., one or more processors of on-board computer 120*a*, one or more components of on-board computer including communication device 122*a*, visual display device 126*a*, train database 124*a*, etc.), HOT device 102, EOT device 104, or a remote server 110 (e.g., one or more processors of remote server 110, etc.).

As shown in FIG. 2, at step 202, process 200 includes the HOT device 102 receiving or sensing an information notification originating from an EOT device associated with a first train in a geographic area, the information notification including at least one of traversal information associated with a position of the first train in a track network or an identifier associated with the first train. For example, in some non-limiting embodiments or aspects, the HOT device 102 receives or senses an information notification originating from an EOT device 108 associated with a first train in a geographic area, the information notification including at least one of traversal information associated with a position of the first train in a track network or an identifier associated with the first train.

In some non-limiting embodiments or aspects, the HOT device 102 receives or senses an information notification originating from an EOT device 108 associated with a first train in a geographic area based on a known or predicted communication loss between the on-board computer 120*a* and a remote server (e.g., PTC back office computer, dispatcher, etc.).

In some non-limiting embodiments or aspects, the information notification includes an operational notification broadcast including operational information for communicating information relevant to an end of the first train to an onboard computer in a head end of the listener train. For example, the HOT device 102 receives or senses an information notification originating from an EOT device 108 associated with a first train in a geographic area, the information notification including at least one of traversal information associated with a position of the first train in a track network or an identifier associated with the first train.

In some non-limiting embodiments or aspects, the information notification includes an inter-train warning message. For example, the information notification is programmed or configured to include a warning portion for communicating warning information relevant to one or more trains within a threshold of the first train. In some non-limiting embodiments or aspects, the inter-train warning message is directed to the listener train. For example, train 20 includes a computer (e.g., on-board computer 120*a*, EOT device 108, HOT device 106, etc.) to configure the warning information to include particular information. In some non-limiting embodiments or aspects, the particular information is included because it is relevant to the listener train, a railway occupied by the listener train, or the area around the railway occupied by the listener train.

In some non-limiting embodiments or aspects, EOT device 108 transmits the information notification at a predetermined time (e.g., randomly, periodically, scheduled, based on an event, etc.). In some non-limiting embodiments or aspects, the EOT device 108 re-broadcasts messages received from HOT devices on other trains in the railway (e.g., provide information notifications from both trains to get to the HOT devices on both trains, etc.). For example, EOT device 108 broadcasts to the HOT device 102 information based on one or more messages received from one or more trains in the railway.

In some non-limiting embodiments or aspects, when the EOT device 108 transmits the inter-train warning message, the inter-train message may not be directed to the listener train. For example, the warning information includes a general event or condition relevant to the listener train and one or more other trains. For example, HOT device 102 receives an inter-train message including a general event or condition not relevant to the listener train.

In some non-limiting embodiments or aspects, the HOT device determines an action based on the general event or condition. For example, the action is based on comparing at least one of the general event or condition to information received and sensed by the listener train to determine a warning alert.

As shown in FIG. 2, at step 204, process 200 includes identifying the first train based on at least one of a position of the first train or an identifier. For example, in some non-limiting embodiments or aspects, HOT device 102 identifies the first train in a railway based on at least one of the position of the first train or the identifier associated with the first train. In some non-limiting embodiments or aspects, HOT device 102 identifies the first train in a railway occupied by the listener train based on the at least one position of the first train or the at least one identifier associated with the first train. For example, HOT device 102 identifies the first train based on an information notification including a position of a first train in a railway.

In some non-limiting embodiments or aspects, the HOT device forwards the information notification to the on-board computer 120*a* before identifying the first train. In some non-limiting embodiments or aspects, on-board computer 120*a* identifies the first train after receiving the information notification based on at least one of the position of the first train or the identifier associated with the first train. For example, on-board computer 120*a* identifies the first train based on the information notification including a position or location of a first train in a railway. For example, the on-board computer 120*a* identifies the first train based on one or more events or conditions of the first train.

In some non-limiting embodiments or aspects, HOT device 102 and/or the on-board computer 120*a* identifies the first train based on an operational notification broadcast from the first train (e.g., an intra-train operational notification, message between the first train and the listener train, message between one or more trains in proximity to the first train, etc.). For example, HOT device 102 receives the operational notification broadcast from the first train and identifies the first train based on operational information associated with the one or more events or conditions of the first train. In some non-limiting embodiments or aspects, the HOT device 102 or on-board computer 120*a* receives operational information (e.g., a message, etc.) including data fields. For example, the data fields may include one or more of a message type (e.g., Status, Arm, etc.), an EOT identifier, battery status (e.g., good, weak, dead), battery charge used, brake pipe pressure (e.g., psi, etc.), emergency valve status (e.g., good, fail, etc.), air turbine equipped data (e.g., yes or no), motion status (e.g., stopped, moving, etc.), marker light status (e.g., on or off), GPS status (e.g., available, unavailable, etc.), location (e.g., latitude, longitude, etc.), location confidence/uncertainty, speed, heading (e.g., orientation to true/magnetic north, etc.).

As shown in FIG. 2, at step 206, process 200 includes determining one or more events or conditions of the first train in the track network based on the information notification. For example, in some non-limiting embodiments or aspects, the on-board computer 120*a* determines one or more events or conditions of the first train in the track network based on the information notification. In some non-limiting embodiments or aspects, the on-board computer 120*a* determines one or more events or conditions of the first train in the track network after the on-board computer 120*a* identifies the first train in the railway. In some non-limiting embodiments or aspects, the on-board computer 120*a* determines one or more events or conditions of the first train in the track network after the HOT device 102 identifies the first train in the railway.

In some non-limiting embodiments or aspects, the HOT device 102 forwards the information notification to the on-board computer 120*a* after identifying the first train. In some non-limiting embodiments or aspects, the the HOT device 102 forwards these messages to the on-board computer 120*a* (e.g., PTC system, etc.) after processing. For example, the HOT device 102 processes the information notification to determine at least one field to forward to the on-board computer (e.g., PTC system, etc.). In some non-limiting embodiments or aspects, the HOT device forwards at least the EOT identifier and location information to the on-board computer 120*a*.

In some non-limiting embodiments, the on-board computer 120*a* determines the information notification comprises an operational notification broadcast (e.g., communicated to any train in the railway, etc.) from the first train and including operational information associated with the one or more event or conditions of the first train.

In some non-limiting embodiments or aspects, the on-board computer 120*a* determines an action based on the one or more events or conditions of the first train and an event or condition in the listener train. For example, on-board computer 120*a* determines the first train is traveling on a route including at least one first track in a railway of a current route of the listener train. In some non-limiting embodiments or aspects, on-board computer 120*a* compares train information of the first train with train information of the listener train. For example, the on-board computer 120*a* compares at least one of a distance to the first train, a speed of the first train, or a condition of the at least first one track in the railway.

In some non-limiting embodiments or aspects, the on-board computer 120*a* determines a safe action for travel based on comparing train information.

In some non-limiting embodiments or aspects, the on-board computer 120*a* determines a safe action for travel based on comparing train information before controlling the train based on the safe action.

In some non-limiting embodiments or aspects, on-board computer 120*a* determines one or more events or conditions based on at least one parameter. For example, on-board computer 120*a* determines one or more events or conditions based on the at least one parameter associated with at least one of track geometry, weather conditions, track conditions, location or position coordinates, velocity or acceleration of the listener train, or velocity or acceleration of one or more other trains.

As shown in FIG. 2, at step 208, process 200 includes generating an updated operation of the listener train including one or more actions, the updated operation based on the one or more events or conditions associated with the first train. For example, in some non-limiting embodiments or aspects, on-board computer 120*a* generates an updated operation of the listener train including one or more actions. For example, on-board computer 120*a* generates an updated operation based on the one or more events or conditions associated with the first train. In some non-limiting embodiments or aspects, the on-board computer 120*a* and/or HOT device 102 alerts an operator as to at least one action associated with avoiding a hazard in the track network. In some non-limiting embodiments or aspects, the on-board computer 120*a* and/or HOT device 102 alerts an operator as to at least one action associated with avoiding a hazard in the track network before controlling a movement of the listener train based at least partially on the at least one action.

In some non-limiting embodiments or aspects, the on-board computer 120*a* and/or HOT device 102 alerts an operator by displaying, by a display connected to the on-board computer 120*a* and/or HOT device 102, a map including a position or location of the first train. For example, the on-board computer 120*a* and/or HOT device 102 alerts an operator by displaying information about the railway (e.g., a map, speed restriction, occupied track information, etc.) in response to an alert. In some non-limiting embodiments or aspects, on-board computer 120*a* communicates a plurality of actions to an operator interface onboard a control car of the listener train. For example, on-board computer 120*a* communicates a plurality of actions including the at least one action associated with avoiding the hazard. In some non-limiting embodiments or aspects, the on-board computer 120*a* and/or HOT device 102 receives (e.g. receives a selection from a train operator with the operator interface, etc.) a selection of at least one of the plurality of actions.

As shown in FIG. 2, at step 210, process 200 includes controlling, by the on-board computer 120*a*, a movement of the listener train based on at least one of the one or more actions. For example, in some non-limiting embodiments or aspects, the HOT device 102 receives or senses an information notification originating from an EOT device 108 associated with a first train in a geographic area, the information notification including at least one of traversal information associated with a position of the first train in a track network or an identifier associated with the first train. In some non-limiting embodiments or aspects, the EOT device 108 forwards the information notification to the on-board computer 120*a*. In some non-limiting embodiments or aspects, the on-board computer 120*a* controls the train 10 in relation to train 20 based on the traversal information and/or the identifier associated with the first train (e.g., maintains a safe speed or distance, etc.)

In some non-limiting embodiments or aspects, on-board computer 120*a* issues a command in response to the selection. For example, in some non-limiting embodiments or aspects, the on-board computer 120*a* performs a braking command. For example, to account for potential communication loss of communication between the on-board PTC system and the PTC back office, the on-board computer 120*a* (e.g., PTC system) performs the braking command decisions described in the use cases above.

Figure 3A:
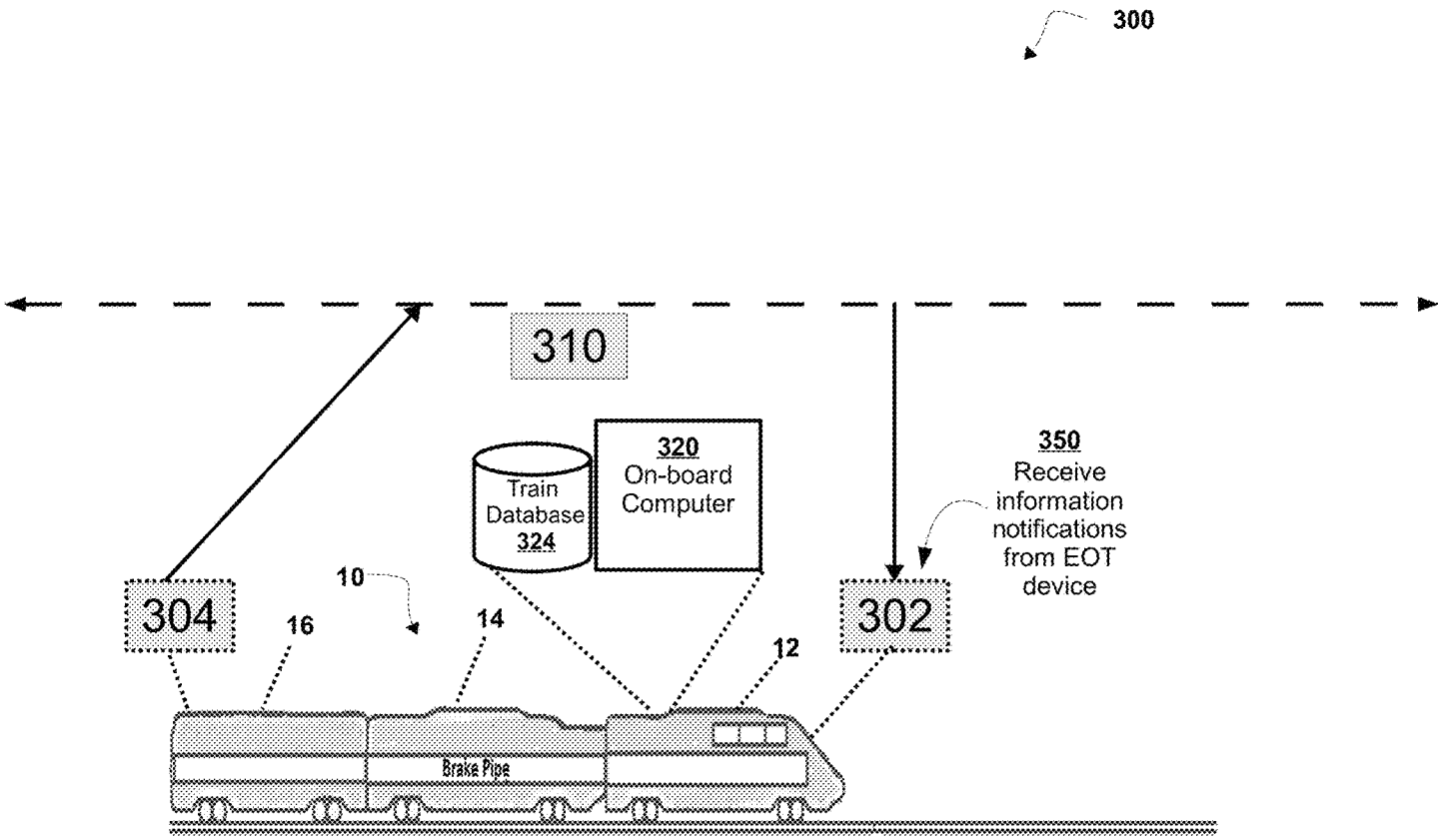
FIGS. 3A-3C illustrate an implementation of a non-limiting embodiment of a process disclosed herein according to a preferred and non-limiting embodiment or aspect.
Figure 3B:
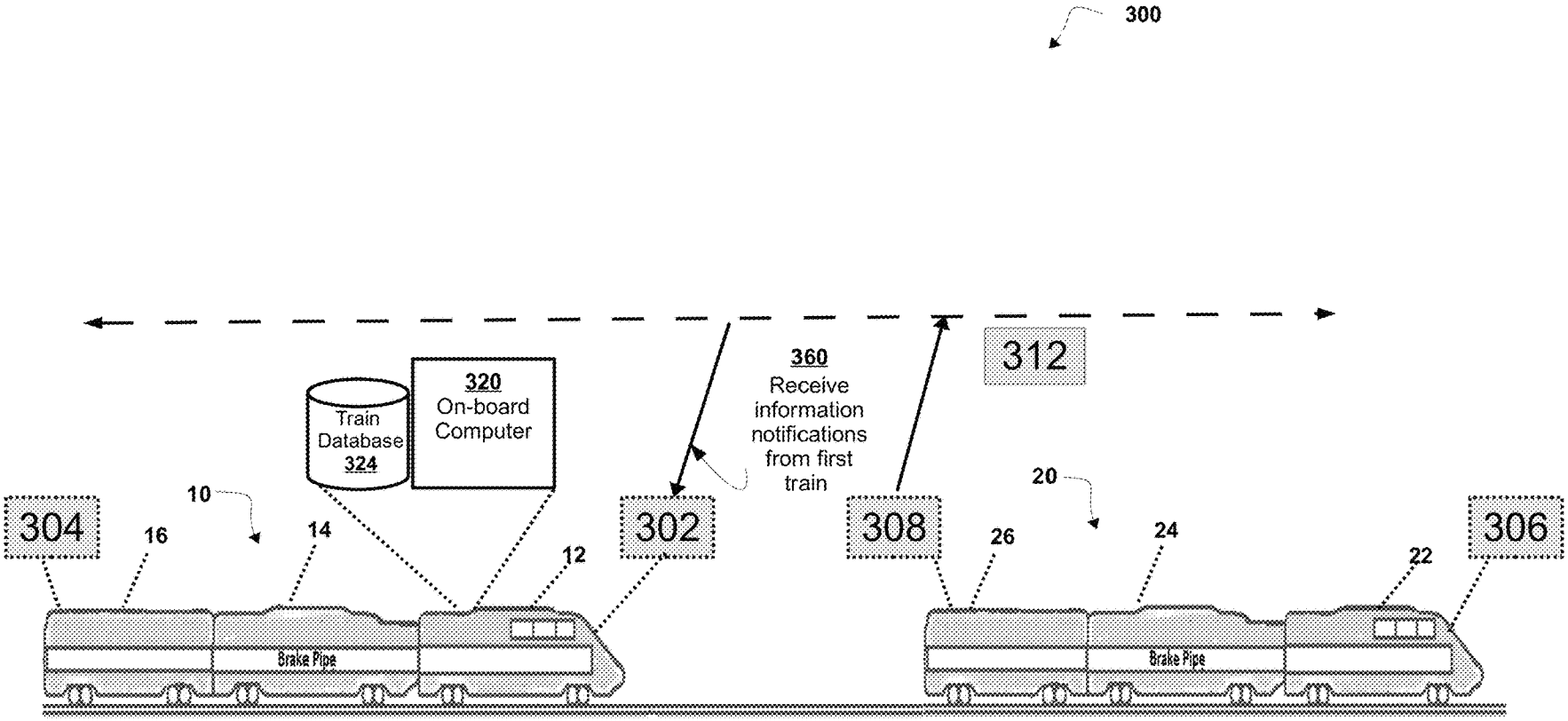

Referring now to FIGS. 3A-3B, FIGS. 3A-3B are diagrams of an overview of a non-limiting embodiment of an implementation 300 relating to a train-to-train warning system 100. As shown in FIGS. 3A-3B, implementation 300 may include a train 10, a HOT device 302, an EOT device 304, an on-board computer 320*a*, and a train database 324. In some non-limiting embodiments or aspects, HOT device 302 and EOT device 304 may be the same or similar to HOT device 102 and EOT device 104, respectively. In some non-limiting embodiments or aspects, on-board computer 320 may be the same or similar to on-board computer 120*a*.

As shown by reference number 350 in FIG. 3A, implementation 300 includes receiving information notifications. For example, EOT device 304 generates and/or transmits an information notification 310 via a trainlink (e.g., an omnidirectional signal, RF signal, etc.). HOT device 302 then receives the information notification 310 to the EOT device 304 (e.g., via the trainlink, etc.). For example, HOT device receives the information notification 310 from EOT device 304 associated with a position or location of end of train railcar 16 at a rear of the train 10.

As shown by reference number 360 in FIG. 3B, implementation 300 includes receiving information notifications from a first train 20 in the railway. For example, EOT device 308 generates and/or transmits an information notification 312 via an omnidirectional signal. In some non-limiting embodiments or aspects, HOT device 302 receives the information notification 312 from EOT device 308 while remaining armed to the EOT device 304. For example, HOT device receives information notification 312 including location information associated with EOT device 308 at an end of train railcar 26.

In some non-limiting embodiments or aspects, EOT device 308 transmits an information notification 312 via a trainlink (e.g., an omnidirectional signal, RF signal, etc.). For example, HOT device 302 receives the information notification 312 via the trainlink while armed to the EOT device 304. For example, HOT device 302 receives information notification 312 and updates the on-board computer 320.

Figure 3C:
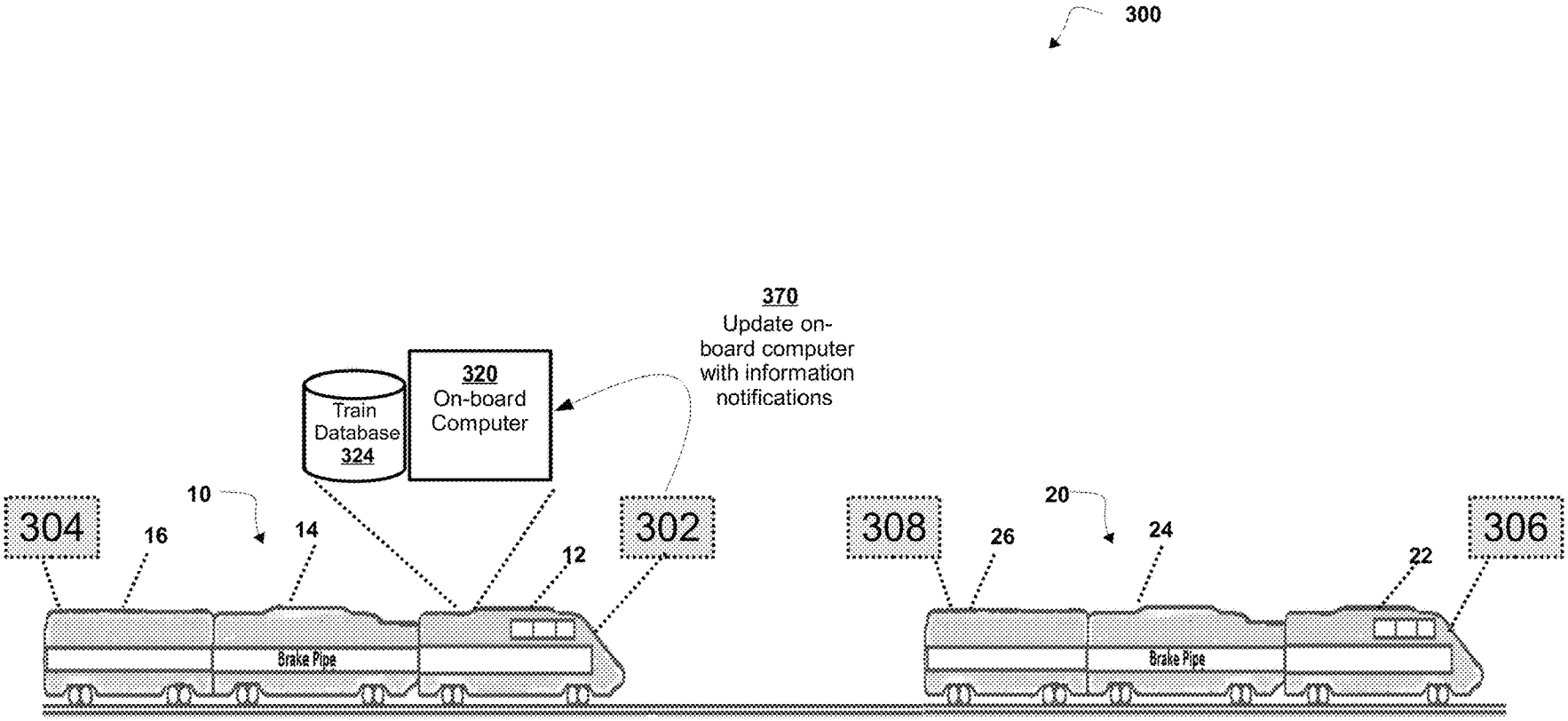

As shown by reference number 370 in FIG. 3C, implementation 300 includes updating an on-board computer 320 with information notifications. For example, EOT device 308 generates and/or transmits an information notification 312 via an omnidirectional signal, HOT device 302 receives the information notification 312 from EOT device 308 while remaining armed to EOT device 304 (e.g., information notifications 312 of EOT device 308, information notifications 310 of EOT device 304, etc.), and HOT device 302 communicates (e.g., transmits, sends, stores, etc.) to onboard computer 320. For example, HOT device 302 communicates information notification 312 identifying a location of at least a portion of train 20 in an unsafe location to an onboard computer and/or a remote computer for controlling train 10. In some non-limiting embodiments, onboard computer 320 controls a movement of the train based on the information notification 312.

In some non-limiting embodiments or aspects, the train-to-train warning system may further include a web portal. The web portal may be an interface through which railroads may define information notifications. By way of a non-limiting example, the web portal may display alerts and report events associated with one or more information notifications.

In some non-limiting embodiments or aspects, the train-to-train warning system may further include a computer application, such as a smart phone application, through which users may receive push notifications. By way of a non-limiting example, the push notifications may depend on the role of the users, such as whether the users are associated with the railroad for the train 10 or is associated with another specified entity, such as a first responder.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the description. For example, it is to be understood that the present invention contemplates that, to the extent possible, one or more features of any embodiment can be combined with one or more features of any other embodiment.

What is claimed is:

1. A computer-implemented train-to-train warning method, the method comprising:

receiving or sensing, by a head of train computer of a listener train, an information notification originating from an end of train device associated with a first train in a geographic area, the information notification including at least one of traversal information associated with a position of the first train in a track network or an identifier associated with the first train, the information notification also including a warning that indicates one or more of (a) the listener train is running too close to the first train, (b) the first train is located on a siding, or (c) the first train is located in a railyard on a rail on which the listener train is running;

determining that a response should be sent based on the information notification;

and sending a response based on the information notification to the listener train, the response including a command to (a) slow down or (b) stop to avoid a collision with the first train.

2. The method of claim 1, wherein the information notification comprises an intra-train operational notification broadcast including operational information for communicating information regarding an end of the first train to an on-board computer in a head of the listener train.

3. The method of claim 2, further comprising:

determining the information notification comprises the intra-train operational notification broadcast from the first train and including operational information associated with the one or more events or conditions of the first train; and determining an action based on the one or more events or conditions of the first train and an event or condition in the listener train.

4. The method of claim 3, wherein the one or more events or conditions are based on at least one parameter, the at least one parameter associated with at least one of track geometry, weather conditions, track conditions, location or position coordinates, velocity or acceleration of the listener train, or velocity or acceleration of one or more other trains.

5. The method of claim 1, wherein the information notification comprises an inter-train warning message, including a warning portion for communicating warning information regarding one or more trains within a threshold of the first train.

6. The method of claim 5, wherein the inter-train warning message is directed to the listener train, the warning information including particular information regarding the listener train.

7. The method of claim 6, wherein the information notification is transmitted at a predetermined time, randomly or periodically.

8. The method of claim 7, wherein the inter-train warning message is directed to the listener train, the warning information including a particular event or condition relevant to the listener train, the method further comprising:

determining an action based on the particular event or condition relevant to the listener train.

9. The method of claim 5, wherein the inter-train warning message is not directed to the listener train, the warning information including a general event or condition relevant to the listener train and one or more other trains, the method further comprising:

determining an action based on the general event or condition, wherein the action is based on comparing at least one of the general event or condition to information received and sensed by the listener train to determine a warning alert.

10. The method of claim 9, wherein determining the action further comprises:

determining the first train is traveling on a route including at least one first track in a railway of a current route of the listener train;

comparing train information of the listener train with at least one of a distance to the first train, a speed of the first train, or a condition of the at least one first track in the railway;

determining a safe action for travel based on comparing train information; and controlling the train based on the safe action.

11. The method of claim 1, further comprising:

alerting an operator as to at least one action associated with avoiding a hazard in the track network; and controlling a movement of the listener train based at least partially on the at least one action.

12. The method of claim 11, further comprising:

displaying, by a display connected to the on-board computer, in response to an alert, a map including a position or location of the first train;

communicating a plurality of actions including the at least one action associated with avoiding the hazard to an operator interface onboard a control car of the listener train;

receiving, with the operator interface, a selection of at least one of the plurality of actions; and issuing a command in response to the selection.

13. A train-to-train warning system for generating an information notification on a train, comprising:

(a) an end of train device in communication with at least one head of train device, the end of train device programmed or configured to:

(i) determine traversal information associated with a position or location of a first train in a track network;

(ii) generate and transmit an information notification to a second train for detecting an event and/or condition associated with the first train, the information notification including at least the traversal information and an identifier associated with the end of train device; and (iii) broadcast the information notification to a head of train computer;

(b) the head of train computer of the second train programmed or configured to:

(i) receive the information notification from the end of train device, the information notification including at least one of traversal information associated with the position of the first train in the track network and the identifier associated with the first train, the information notification also including a warning that indicates one or more of (a) the listener train is running too close to the first train, (b) the first train is located on a siding, or (c) the first train is located in a railyard on a rail on which the listener train is running; and (c) an on-board computer programmed or configured to:

(i) determine that a response should be sent based on the information notification;

(ii) send a response based on the information notification to the listener train, the response including a command to (a) slow down or (b) stop to avoid a collision with the first train.

14. The system of claim 13, wherein the information notification comprises an inter-train warning message comprising a warning portion for communicating warning information relevant to one or more trains within a threshold of the first train, wherein the inter-train warning message is directed to the second train, the warning information including a particular event or condition relevant to the second train, the on-board computer further configured to:

determine an action based on the particular event or condition regarding the second train.

15. The system of claim 13, wherein the information notification comprises an inter-train warning message comprising a warning portion for communicating warning information relevant to one or more trains within a threshold of the first train, wherein the inter-train warning message is not directed to the second train, the warning information including a general event or condition relevant to the second train and one or more other trains, the on-board computer further configured to:

determine an action based on the general event or condition, wherein the action is based on comparing at least one of the general event or condition to information received and sensed by the second train to determine a warning alert.

16. The system of claim 13, wherein determining the one or more actions, the on-board computer further configured to:

determine the first train is traveling on a route including at least one first track in a railway of a current route of the second train;

compare train information of the second train with at least one of a distance to the first train, a speed of the first train, or a condition of the at least one first track in the railway;

determine a safe action for travel based on comparing train information; and control the train based on the safe action.

17. The system of claim 13, further configured to:

alert an operator as to at least one action associated with avoiding a hazard in the track network; and control a movement of the second train based at least partially on the at least one action.

18. The system of claim 17, further configured to:

display, by a display connected to the on-board computer, in response to receiving an alert, a map including a position or location of the first train;

communicate a plurality of actions including the at least one action associated with avoiding the hazard to an operator interface onboard a control car of the second train;

receive, with the operator interface, a selection of at least one of the plurality of actions; and issue a command in response to the selection.

19. A computer program product comprising at least one non-transitory computer-readable medium including program instructions that, when executed by at least one computer including at least one processor, causes the at least one computer to:

receive or sense an information notification originating from an end of train device associated with a first train in a geographic area, the information notification including at least one of traversal information associated with a position of the first train in a track network or an identifier associated with the first train, the information notification also including a warning that indicates one or more of (a) the listener train is running too close to the first train, (b) the first train is located on a siding, or (c) the first train is located in a railyard on a rail on which the listener train is running;

determine that a response should be sent based on the information notification; and send a response based on the information notification to the listener train, the response including a command to (a) slow down or (b) stop to avoid a collision with the first train.

20. The computer program product of claim 19, wherein the information notification comprises an intra-train operational notification broadcast including operational information for communicating information regarding an end of the first train to an on-board computer in a head of the second train, the computer program product including further program instructions that, when executed by at least one computer including at least one processor, causes the at least one computer to:

determine the information notification comprises an intra-train operational notification broadcast from the first train and including operational information associated with an event or condition of the first train; and determine an action based on the event or condition of the first train and an event or condition in the second train.

* * * * *